US006666472B2

(12) United States Patent
Joubert Des Ouches

(10) Patent No.: US 6,666,472 B2
(45) Date of Patent: Dec. 23, 2003

(54) INTERFACE PLATE MOUNTED ON A SNOWBOARD

(75) Inventor: Pascal Joubert Des Ouches, Coublevie (FR)

(73) Assignee: Skis Rossignol S.A., Voiron (FR)

( * ) Notice: Subject to any disclaimer, the term of this patent is extended or adjusted under 35 U.S.C. 154(b) by 91 days.

(21) Appl. No.: 09/725,657

(22) Filed: Nov. 29, 2000

(65) Prior Publication Data

US 2001/0002080 A1 May 31, 2001

(30) Foreign Application Priority Data

Nov. 30, 1999 (FR) ..... 99 15061

(51) Int. Cl.[7] ..... A63C 5/06; A63C 9/02

(52) U.S. Cl. ..... 280/607; 280/613; 280/14.21

(58) Field of Search ..... 280/14.2, 607, 280/613, 618, 626, 633; 403/322.1, 348, 350, 374.1

(56) References Cited

U.S. PATENT DOCUMENTS

| | | | | | |
|---|---|---|---|---|---|
| 4,741,550 | A | * | 5/1988 | Dennis | 280/618 |
| 5,044,654 | A | * | 9/1991 | Meyer | 280/613 |
| 5,188,386 | A | * | 2/1993 | Schweizer | 280/607 |
| 5,236,216 | A | | 8/1993 | Ratzek | 280/607 |
| 5,299,823 | A | | 4/1994 | Glaser | 280/625 |
| 5,435,080 | A | * | 7/1995 | Meiselman | 36/117.1 |
| 5,474,322 | A | * | 12/1995 | Perkins et al. | 280/613 |
| 5,556,123 | A | * | 9/1996 | Fournier | 280/607 |
| 5,636,455 | A | * | 6/1997 | Meiselman | 36/115 |
| 5,655,786 | A | * | 8/1997 | Raftogianis | 280/14.2 |
| 5,669,630 | A | * | 9/1997 | Perkins et al. | 280/613 |
| 5,671,939 | A | * | 9/1997 | Pineau | 280/602 |
| 5,775,717 | A | * | 7/1998 | Bobrowicz | 280/607 |
| 5,803,481 | A | * | 9/1998 | Eaton et al. | 280/633 |
| 5,810,370 | A | | 9/1998 | Covert et al. | 280/14.2 |
| 5,895,068 | A | * | 4/1999 | Doyle | 280/618 |
| 5,909,894 | A | * | 6/1999 | Meader et al. | 280/623 |
| 5,947,508 | A | * | 9/1999 | Graf et al. | 280/616 |
| 6,007,085 | A | * | 12/1999 | Rigal et al. | 280/607 |
| 6,065,767 | A | * | 5/2000 | Girotto et al. | 280/607 |
| RE36,800 | E | * | 8/2000 | Vetter et al. | 280/618 |
| 6,113,113 | A | * | 9/2000 | Longoni et al. | 280/14.2 |
| 6,189,911 | B1 | * | 2/2001 | Caron et al. | 280/607 |
| 6,196,569 | B1 | * | 3/2001 | Berger et al. | 280/607 |
| 6,234,513 | B1 | * | 5/2001 | Busby, Jr. et al. | 280/602 |
| 6,290,423 | B1 | * | 9/2001 | Jungkind | 403/322.1 |
| 6,296,258 | B2 | * | 10/2001 | Higgins et al. | 280/14.22 |
| 6,412,793 | B2 | * | 7/2002 | de France | 280/14.21 |
| 6,505,841 | B1 | * | 1/2003 | Kessler et al. | 280/14.22 |

FOREIGN PATENT DOCUMENTS

| | | |
|---|---|---|
| NL | 9101938 | 6/1993 |

* cited by examiner

*Primary Examiner*—Brian L. Johnson
*Assistant Examiner*—Bridget Avery
(74) *Attorney, Agent, or Firm*—Heslin Rothenberg Farley & Mesiti P.C.; Victor A. Cardona

(57) ABSTRACT

Interface plate (1) intended to be inserted between a snowboard binding and the upper face of a snowboard, and which comprises:

an essentially circular central zone (2) through which the screws (38) for attaching the binding to the board can pass;

two outer zones (3, 4) of a width smaller than the diameter of the central zone (2), arranged symmetrically with respect to the central zone (2), and of which the ends furthest from the central zone (2) act as supports for diametrically opposed zones of the binding so as to transmit the forces exerted from the binding to the board only at said outer zones (34) which are advantageously located near to the edges (9, 10).

11 Claims, 4 Drawing Sheets

INTERFACE PLATE MOUNTED ON A SNOWBOARD

TECHNICAL FIELD

The invention relates to the field of gliding sports and, more precisely, to the snow sport generally known as snowboarding. It relates more specifically to an element forming an interface plate intended to be inserted between the actual binding and the board, so as to optimize the transmission of the forces and the behavior of the board.

PRIOR ART

In a known way, snowboard bindings are mounted on the snowboard with a certain latitude for rotation, to allow the angle of the longitudinal mid-plane of the corresponding binding to be adjusted to that of the foot with respect to the longitudinal axis of the board.

Specifically, in order to be able to adopt the most ergonomical position possible, it may be necessary for the front and back feet to have a certain orientation with respect to the board.

This orientation may differ from the front foot with respect to the back foot, and may also vary according to the type of riding. Thus, in the freestyle type of riding, the orientation of the feet, and therefore of the binding, is further from the longitudinal axis of the board than it is for alpine riding in which the feet are closer to the longitudinal axis of the board.

Furthermore, there are two possible orientations of the foot with respect to the perpendicular to the longitudinal axis of the board.

Specifically, certain snowboarders prefer to have their left foot at the front end of the board. Surfers who ride in this way are known as "regular".

Conversely, certain snowboarders prefer to have their right foot at the front end of the board. Such snowboarders are known as "goofy". As the back foot is generally more perpendicular to the longitudinal axis of the board than the front foot, it then follows that the binding may adopt an angle that varies widely depending on whether it is used by a "goofy" snowboarder or a "regular" snowboarder.

Moreover, it has been found that the forces are generally exerted from the binding to the board and located essentially in the region of the extreme zones of the binding corresponding to the front of the foot in the case of frontside turns and corresponding to the back of the foot in the case of backside turns.

In other words, the forces are exerted in a way which is offset with respect to the edges according to the orientation of the binding with respect to the board.

The further the foot is away from the perpendicular, the more the thrust is exerted in a zone away from the edges, and therefore the less effective this thrust is.

A first problem that the invention sets out to solve is that of optimizing the location of the thrust exerted from the binding, regardless of the orientation of the binding with respect to the longitudinal axis of the board.

Moreover, in the most frequent case where the binding is not perpendicular to the longitudinal axis of the board, the two zones for transmitting thrust from the binding to the board, located at the front and at the back of the foot, are longitudinally offset with respect to the board. It then follows that the part of the binding located between these two thrust zones has a rigidity which adds to and combines with the intrinsic rigidity of the board.

This interference modifies the intrinsic mechanical strength characteristics of the board and causes it to diverge from its theoretical behavior. A modification such as this is detrimental to the ability of the board to withstand the forces.

Specifically, numerous instances of boards breaking at the extreme zones of the binding as a result of the appearance of excessive stress when bowing the board have, in particular, been observed.

Another problem that the invention sets out to solve is that of decoupling the binding with respect to the board and of reducing the influence of the mechanical rigidity of the binding on the intrinsic mechanical properties of the board.

The object of the invention is therefore to optimize the thrust exerted from the binding to the board while at the same time allowing a certain decoupling of rigidity of the binding and of the board, while remaining compatible with the latitude for adjustment of the orientation of the binding with respect to the longitudinal axis of the board, according to the various styles of riding and the various types of user.

SUMMARY OF THE INVENTION

The invention therefore relates to an interface plate intended to be inserted between a snowboard binding and the upper face of a snowboard.

This plate is noteworthy in that it comprises:

- an essentially circular central zone through which the screws for attaching the binding to the board can pass;
- two outer zones of a width smaller than the diameter of the central zone, arranged symmetrically with respect to the central zone, and of which the ends furthest from the central zone act as supports for diametrically opposed zones of the binding so as to transmit the forces exerted from the binding to the board only at said outer zones which are advantageously located near to the edges.

In other words, the plate according to the invention is intended to be arranged in such a way that these outer zones are as close as possible to the edges, which essentially corresponds to a position in which the interface plate has its longitudinal mid-plane perpendicular to the longitudinal axis of the board.

In that way, contact between the binding and the board is predominantly at these outer zones of the plate, which are located near to the edges.

The thrust exerted from the binding to the board is therefore mainly concentrated near the edges, which improves the precision and control of the snowboard.

Furthermore, by virtue of the characteristic plate, the mechanical influence of the binding on the board is essentially limited to a zone which is reduced in size in the longitudinal direction of the board. In that way, the impact that the rigidity of the binding has is relatively low when bowing the board. The latter therefore retains its intrinsic mechanical properties and its optimum behavior.

Depending on the orientation of the binding with respect to the board, the ends of the plate furthest from the central zone act as supports for diametrically opposed zones of the binding arranged on a diagonal with respect to the latter.

In other words, the interface plate remains fixed with respect to the board and the zones of contact of the plate with respect to the binding change according to the orientation of the binding with respect to the board. However, the force-transmission zones corresponding to the outer zones of the characteristic plate always remain near the edges regardless of the orientation of the binding.

The geometry of the plate is determined in such a way that the orientation of the binding can vary in a large range of angles, while overlapping the characteristic plate so as to enjoy the transmission of thrust near the edges.

According to another feature of the invention, the interface plate may be associated with a peripheral gasket arranged essentially vertically above the outer contour of the baseplate of the binding so as to prevent snow from penetrating under said baseplate.

This peripheral gasket may either be incorporated into the binding or alternatively may be an independent part, the position of which changes with the orientation of the binding.

This prevents snow from accumulating under the baseplate and, when frozen, forming a rigid block which would allow forces to be transmitted from the binding to the board outside of the favored zones that the outer zones of the plate constitute.

Advantageously in practice, the central zone may comprise a cylindrical protrusion arranged at its center and intended to collaborate with a complementary cylindrical opening formed for this purpose in the baseplate of the binding. In this case, the plate is more intended to be used with bindings which have a monolithic baseplate, which is pivoted in its entirety when the orientation of the binding is adjusted.

This pivoting therefore occurs above the characteristic interface plate, the protrusion of which acts as a fixed point.

Conversely, the characteristic plate may be used with another category of binding, in which the baseplate has, at its center, a recess designed to take an indexed disk mounted on the board through the characteristic plate, without the ability to rotate. In this scenario, the remainder of the baseplate of the binding is oriented with respect to this fixed central disk.

Advantageously in practice, the characteristic plate comprises through-holes for the passage of the binding attachment screws.

Moreover, it may prove advantageous to adjust the longitudinal position of the binding according to the ergonomics and to the optimum position desired by the user.

Such an adjustment, known as adjusting the stance, is obtained by virtue of the fact that the holes passing through the characteristic plate form widened slots so as to allow the plate to be shifted in translation with respect to the upper face of the board which has the tapped holes for attaching the binding.

In that way, when the user wishes to shift the position of the binding longitudinally, he shifts both the baseplate of the binding and the characteristic plate by translating these two elements in the direction of the widened slots.

Furthermore, in certain styles of riding, it may prove advantageous for the leg to have a certain orientation with respect to the vertical, particularly during freestyle riding. In this case, the characteristic plate may have upper and lower faces which form an angle of between two and eight degrees, offsetting the inclination or canting of the binding by this same amount with respect to the vertical.

BRIEF DESCRIPTION OF THE DRAWINGS

The way in which the invention can be embodied and the advantages which stem therefrom will become clearly apparent from the description of the embodiments which follow in support of the appended figures, in which.

EMBODIMENTS OF THE INVENTION

As already stated, the invention relates to an interface plate intended to be inserted between the baseplate of the binding and the snowboard, so as to encourage the transmission of thrust from the binding to the board at one same longitudinal level and as close as possible to the edges.

A plate such as this also allows good decoupling of the binding with respect to the board.

Figure 1:
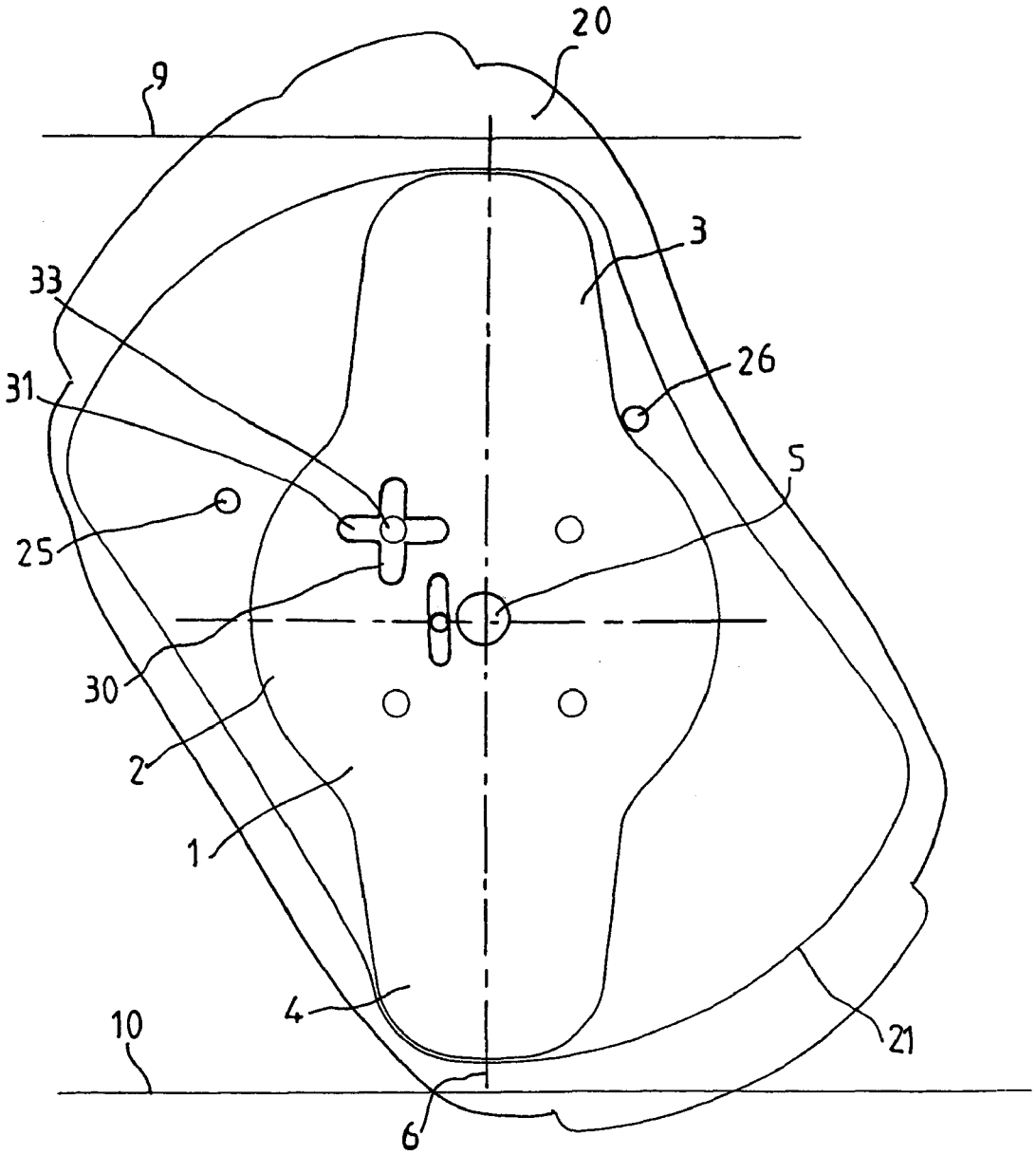
FIG. 1 is a view from above of the characteristic plate and of the associated peripheral gasket.

More specifically, a plate such as this, as illustrated in FIG. 1, comprises an essentially circular central zone with a diameter of the order of about 10 centimeters. This plate (1) has two outer zones (3, 4) arranged symmetrically with respect to the center (5) of the central zone (2).

Each of these outer zones (3, 4) exhibits an essentially trapezoidal or alternatively rectangular or square shape, the sides of which have a length essentially similar to half the diameter of the central zone (2).

These outer zones extend up close to the periphery of the binding, to take thrust only on its outer zones (3, 4).

Thus, the characteristic plate (1) is arranged in such a way that its longitudinal mid-line (6) is perpendicular to the longitudinal mid-line (7) of the board. Thus, the ends of the outer zones (3, 4) are located as close as possible to the edges (9, 10), which improves the transfer of the thrust exerted by the snowboarder and therefore the precision with which the board is controlled.

Furthermore, because the two outer zones (3, 4) are located essentially at the same longitudinal level with respect to the board, the fraction of the board stressed as a result of the presence of the binding is relatively small in terms of longitudinal extent. It then follows that the contribution of the rigidity of the binding to the complete rigidity of the board is low, and at the very least minimized.

In consequence, the behavior of the board equipped with the bindings is closer to the theoretical behavior of the board alone, determined according to the intrinsic characteristics of its mechanical structure.

The presence of the two outer zones (3, 4) located symmetrically with respect to the center (5) of the plate, allows a slight bowing movement of the board with respect to the binding.

In the most frequent case where the binding has an orientation with respect to the longitudinal axis of the board which is different than the perpendicular, the outer zones (3, 4) of the plate are located vertically in line with diagonally opposed regions of the binding.

Thus, in spite of this orientation of the foot, the forces are nonetheless transmitted to the board only at the outer zones (3, 4), and therefore near the edges (9, 10), without generating stress in the board at the longitudinal extent of the binding.

The characteristic plate (1) may be made of various materials and, in particular, of metal or of relatively rigid plastic, such as a polyamide, polyurethane or polypropylene.

The characteristic plate may also receive a layer of viscoelastic material intended to dampen some of the vibration generated by the board, to prevent this vibration from being transmitted from the board to the binding.

A characteristic plate (1) such as this has a thickness of a few millimeters, preferably of between two and three millimeters.

According to another feature of the invention, this plate may have a slope which gives the binding a certain inclination with respect to the upper face of the board so as to adjust the lateral inclination of the binding, known as the canting.

More specifically, the upper and lower faces of the plate (1) may form an angle of a few degrees, for example three or six degrees, between them.

According to another feature of the invention, the characteristic plate is associated with a peripheral gasket (20) located vertically in line with the periphery of the baseplate of the binding, and is essentially intended to avoid the ingress of snow between the baseplate and the board.

This is because the ingress of snow could lead to the formation of a block of ice whose rigidity would modify the zone at which thrust was transmitted from the binding to the board, and therefore corrupt the usefulness of the characteristic plate (1).

A gasket (20) such as this is made of a readily compressible material, so that it does not constitute an element that allows thrust to be transmitted from the binding to the board, which function is the sole preserve of the characteristic plate (1). Thus, a gasket (20) such as this may be made of a compressible foam.

As illustrated in FIGS. 2 to 5, the characteristic plate allows optimum force transmission near the edges, for a very wide variety of binding orientations with respect to the longitudinal mid-line of the board.

Figure 3:
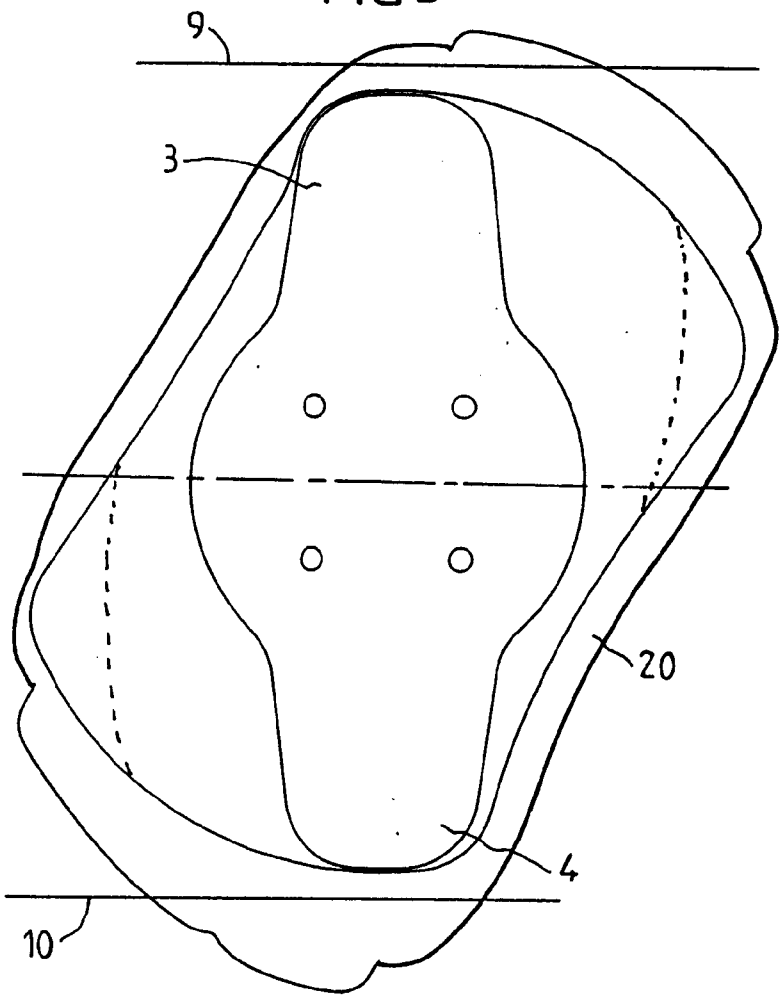
FIGS. 2, 3, 4 and 5 are views from above of the plate and of the peripheral gasket shown in four different binding positions.
Figure 2:
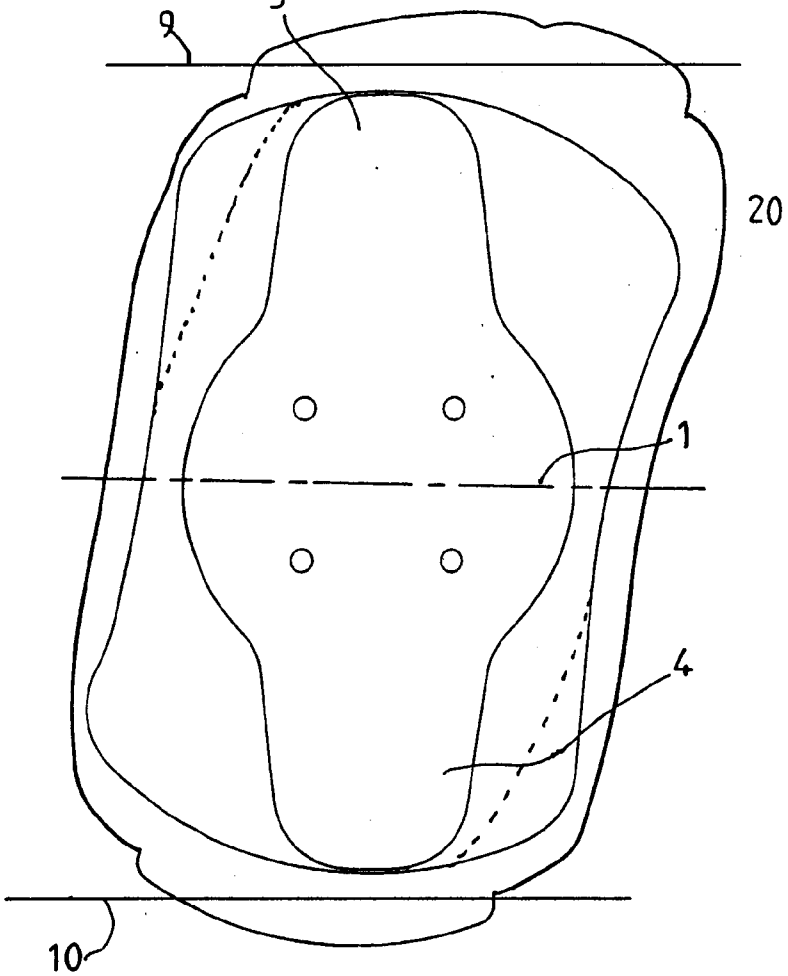
Figure 5:
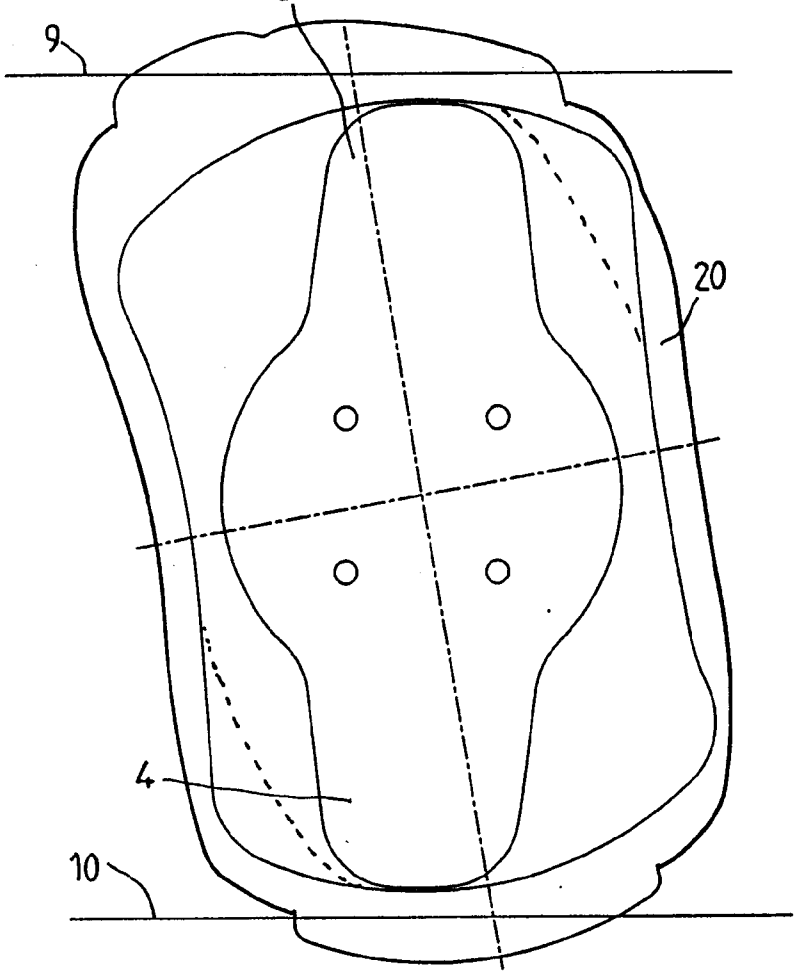
Figure 4:
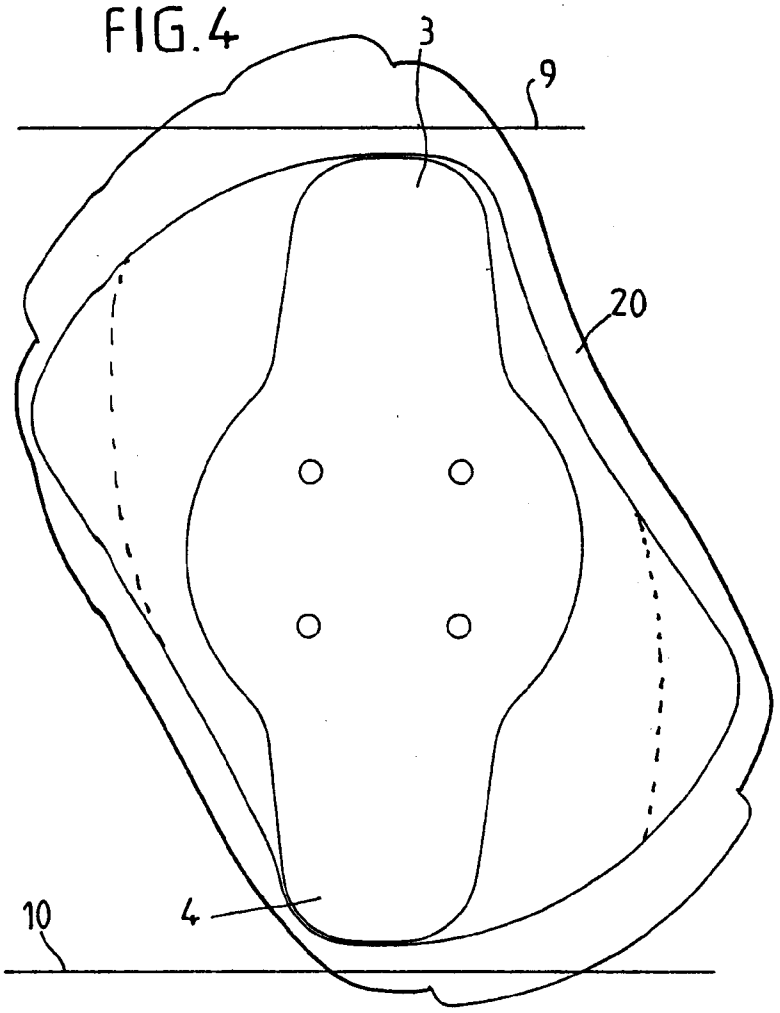

Thus, it is known that the orientations of the bindings can vary from one foot to the other, as illustrated in FIGS. 2 and 3, the front foot generally being closer to the longitudinal axis of the board than the back foot.

Thus, the shape of the characteristic plate, and particularly the relative narrowness of the outer zones (3, 4) allows the binding to pivot, while remaining above the outer zones (3, 4), thus allowing thrust to be transmitted at these zones.

Furthermore, the symmetric geometry of the characteristic plate (1) also allows it to be used for both types of binding orientation used, depending on whether the user is qualified as "regular" or "goofy", as can be seen by comparing FIGS. 2 and 5 or 3 and 4.

The interior profile (21) of the peripheral gasket (20) is defined such that it allows the binding to be orientated for a range of orientations stretching from −30° to +30° between the longitudinal mid-lines of the binding and of the plate.

Of course, a different geometry, and in particular narrower outer zones (3, 4) may lead to an even broader orientation coverage.

To limit the pivoting of the binding in the range determined according to the geometry of the plate and of the gasket, it may be envisioned for two limit studs (25, 26), intended to come into contact with the plate (1) when the binding reaches its maximum position on one side or the other, to be added under the baseplate of the binding.

According to another feature of the invention, the plate (1) may at its center have slots (30, 31) for the passage of screws for attaching the binding to the board.

Such slots (30, 31) may adopt a geometry which allows a slight transverse or longitudinal shifting of the plate (1), and therefore of the binding, according to the optimum position desired by the user.

Thus, if the user wishes to shift the position of the binding longitudinally with respect to the holes (33) drilled in the board, he may shift the plate (1) slightly so that the screw-holes (33) are located in the longitudinal slot (31).

Similarly, if he wishes to shift the binding transversely slightly, it is the transverse slot (30) which will then be used.

According to another feature of the invention, the characteristic plate (1) may, at its center, have a protruding zone (36) intended to collaborate with the binding to make it easier to pivot.

Figure 6:
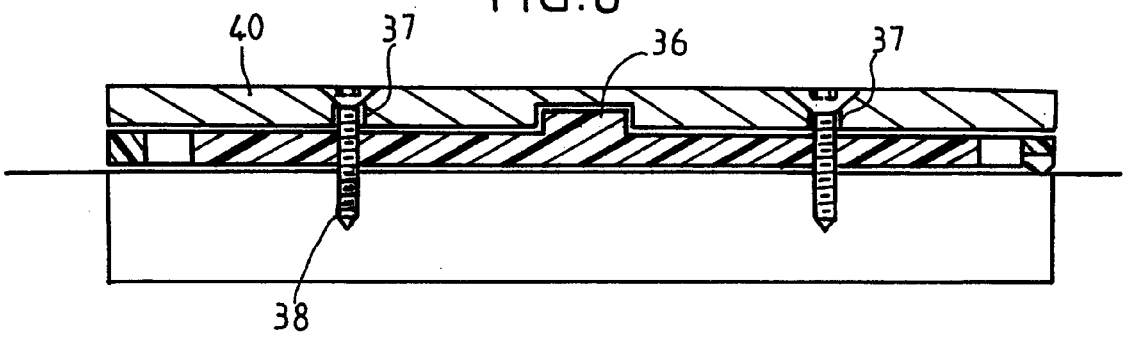
FIG. 6 is a view in section on a plane perpendicular to the longitudinal axis of the board of the plate and of the baseplate of the binding produced according to a first alternative form of embodiment.

A geometry such as this, illustrated in FIG. 6, allows the user to vary the orientation of the binding by pivoting it about the plate, and more particularly about the central protrusion.

In this scenario, the binding (40) has slots (37) in the shape of circular arcs, inside which the binding screws (38) enter. The screws (38) occupy a varying position inside the slot (37) according to the orientation of the binding. In this case, the plate only comprises the 4 or 3 holes corresponding to the position of the inserts in the board for the mounting of the binding.

Figure 7:
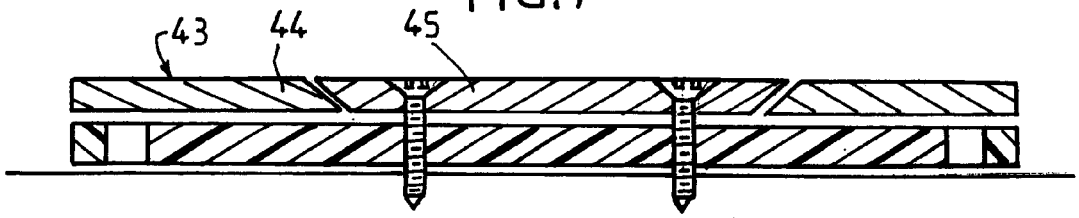
FIG. 7 is also a view in section similar to that of FIG. 6, showing a second alternative form of embodiment of the baseplate.

In the other form of binding illustrated in FIG. 7, the baseplate (43) comprises a central disk (45) which remains fixed with respect to the board, and about which the rest (44) of the baseplate can rotate, the collaboration between the disk (45) and the baseplate (44) indexing the baseplate and holding it in position in the desired orientation. In this case, the plate has the same facility for adjustment as the disk so as to allow it to accompany the movement thereof.

It is evident from the foregoing that the characteristic plate according to the invention has numerous advantages, namely:

it allows forces to be transmitted essentially in the region near to the edges;

it allows rigid decoupling of the binding and of the board.

What is claimed is:

1. An interface plate configured to be inserted between a snowboard binding and the upper face of a snowboard, said interface plate comprising:

an essentially circular central zone through which screws for attaching the binding to the board can pass so that said central zone is fixed relative to the board and at least a portion of the binding is received on a top surface of said central zone;

two outer zones of a width smaller than the diameter of the central zone, said outer zones arranged symmetrically with respect to the central zone, and said outer zones comprising ends located furthest from the central zone wherein said ends act as supports for diametrically opposed zones of the binding to transmit forces exerted from the opposed zones of the binding to the board only at said ends; and wherein said ends transmit the forces substantially independently of an orientation of the binding relative to the snowboard.

2. The plate as claimed in claim 1, wherein the ends of said outer zones furthest from the central zone act as supports for diametrically opposed zones of the binding arranged on a diagonal.

3. The plate as claimed in claim 1, further comprising a peripheral gasket arranged essentially vertically above an outer contour of a baseplate of the binding to inhibit snow from penetrating under said baseplate.

4. The plate as claimed in claim 1, wherein the central zone comprises a cylindrical protrusion arranged at its center for engaging a complementary cylindrical opening formed in a baseplate of the binding.

5. The plate as claimed in claim 1, further comprising through-holes for the passage of the binding attachment screws.

6. The plate as claimed in claim 1, further comprising upper and lower faces wherein said upper and lower faces form an angle of between two and eight degrees.

7. The plate of claim 1 wherein the screws are attachable to the board through the central zone such that the binding is adjustably connectable to the central zone and is adjustable relative to the outer zones.

8. The plate as claimed in claim 5, wherein the holes form widened slots so as to allow the plate to be shifted in translation with respect to the upper face of the board.

9. An interface plate configured to be inserted between a snowboard binding and the upper face of a snowboard, said interface plate comprising:

an essentially circular central zone through which screws for attaching the binding to the board can pass so that said central zone is fixed relative to the board;

two outer zones of a width smaller than the diameter of the central zone, said outer zones arranged symmetrically with respect to the central zone, and said outer zones comprising ends located furthest from the central zone wherein said ends act as supports for diametrically opposed zones of the binding to transmit forces exerted from the opposed zones of the binding to the board only at said ends; and wherein the binding is attached to the board to cause at least a portion of the opposed zones of the binding to be received on top surfaces of the outer zones.

10. The plate of claim 9 wherein the ends transmit the forces substantially independently of an orientation of the binding relative to the snowboard.

11. The plate of claim 9 wherein the screws are attachable to the board through the central zone such that the binding is adjustably connectable to the central zone and is adjustable relative to the outer zones.

* * * * *